US009151300B2

(12) United States Patent
Cho

(10) Patent No.: US 9,151,300 B2
(45) Date of Patent: Oct. 6, 2015

(54) INLINE VACUUM PUMP

(71) Applicant: Korea Pneumatic System Co., Ltd., Seoul (KR)

(72) Inventor: Ho-Young Cho, Seoul (KR)

(73) Assignee: KOREA PNEUMATIC SYSTEM CO., LTD., Seoul (KR)

( * ) Notice: Subject to any disclaimer, the term of this patent is extended or adjusted under 35 U.S.C. 154(b) by 0 days.

(21) Appl. No.: 14/395,757

(22) PCT Filed: Mar. 29, 2013

(86) PCT No.: PCT/KR2013/002614

§ 371 (c)(1),
(2) Date: Oct. 20, 2014

(87) PCT Pub. No.: WO2013/162182

PCT Pub. Date: Oct. 31, 2013

(65) Prior Publication Data

US 2015/0093262 A1 Apr. 2, 2015

(30) Foreign Application Priority Data

Apr. 26, 2012 (KR) ..... 10-2012-0043611

(51) Int. Cl.

| | |
|---|---|
| ***A47J 45/00*** | (2006.01) |
| ***F04F 5/20*** | (2006.01) |
| ***F04F 5/14*** | (2006.01) |

(52) U.S. Cl.
CPC .... *F04F 5/20* (2013.01); *F04F 5/14* (2013.01)

(58) Field of Classification Search
CPC ..... F04F 5/20; F04F 5/14; F04F 5/461; F04F 5/32; B25J 15/0616; B66C 1/02; H01L 21/6838
See application file for complete search history.

(56) References Cited

U.S. PATENT DOCUMENTS

| | | | |
|---|---|---|---|
| 3,899,087 | A | 8/1975 | Tamble et al. |
| 3,902,605 | A | 9/1975 | Hamilton |
| 3,967,849 | A | 7/1976 | Cagle |
| 3,991,997 | A | 11/1976 | Barber |
| 4,029,351 | A | 6/1977 | Apgar et al. |

(Continued)

FOREIGN PATENT DOCUMENTS

| | | | |
|---|---|---|---|
| JP | 2001280240 | A | 10/2001 |
| KR | 100817254 | B1 | 3/2008 |
| WO | 82/02482 | | 8/1982 |

OTHER PUBLICATIONS

International Search Report (mailing date Jun. 3, 2013) for International PCT Patent Application No. PCT/KR2013/002614, filed on Mar. 29, 2013.

*Primary Examiner* — Stephen Vu
(74) *Attorney, Agent, or Firm* — Vic Lin; Innovation Capital Law Group, LLP

(57) ABSTRACT

The present invention relates to a vacuum pump, and more particularly, to an inline vacuum pump. The inline vacuum pump according to the present invention comprises a cylinder-type housing, an ejector, and a guide which are mounted in series on the upper side and the lower side in the housing, and a gripper connector coupled to the lower portion of the housing. The guide is provided with a passage and a path through which compressed air is discharged and exhaust air is absorbed. According to the present invention, device design and production are easier than in the related art, and a vacuum is generated and maintained in a stable manner. Also, the ejector can be relatively freely selected and applied.

14 Claims, 7 Drawing Sheets

(56) References Cited

U.S. PATENT DOCUMENTS

| | | | | | |
|---|---|---|---|---|---|
| 4,640,503 | A | | 2/1987 | Naumann | |
| 4,655,692 | A | | 4/1987 | Ise | |
| 4,736,938 | A | | 4/1988 | Jiruse et al. | |
| 4,753,104 | A | | 6/1988 | Strozier | |
| 4,796,357 | A | * | 1/1989 | Smith | 29/840 |
| 4,950,011 | A | * | 8/1990 | Borcea et al. | 294/2 |
| 5,076,564 | A | | 12/1991 | Marass | |
| 5,193,776 | A | | 3/1993 | Nagai et al. | |
| 5,201,875 | A | | 4/1993 | Tessier et al. | |
| 5,277,468 | A | | 1/1994 | Blatt et al. | |
| 5,451,086 | A | | 9/1995 | Pazzaglia | |
| 5,727,418 | A | | 3/1998 | Strozier | |
| 5,755,471 | A | | 5/1998 | Bjorklund et al. | |
| 6,065,789 | A | | 5/2000 | Nagai et al. | |
| 6,168,220 | B1 | | 1/2001 | Schmalz et al. | |
| 6,213,521 | B1 | | 4/2001 | Land et al. | |
| 6,663,092 | B2 | | 12/2003 | Kashiwazaki et al. | |

* cited by examiner

Fig. 5
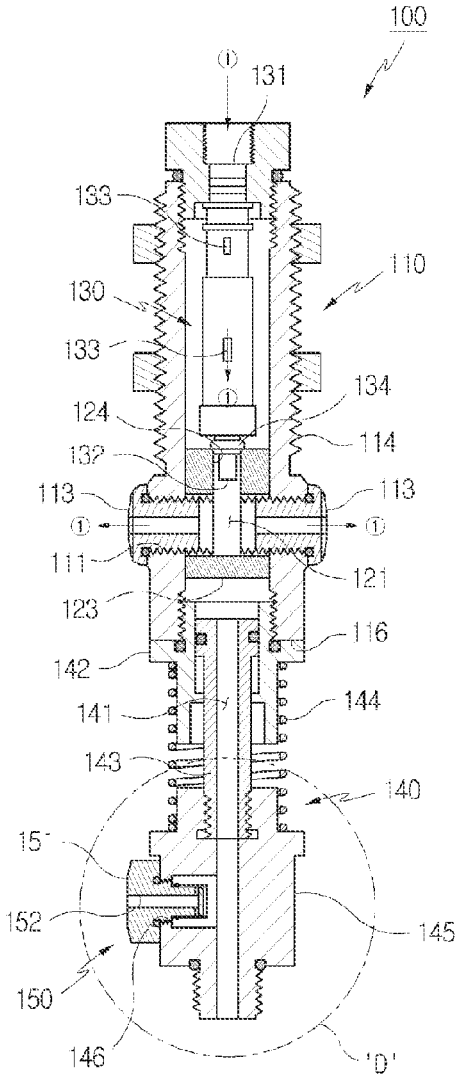
[Fig. 6]
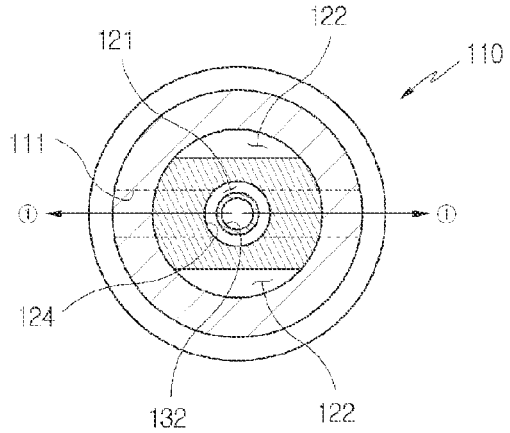

INLINE VACUUM PUMP

TECHNICAL FIELD

The present invention relates, in general, to a vacuum pump configured to discharge air from a certain space using high-speed compressed air and, more particularly, to an inline vacuum pump.

BACKGROUND ART

Generally, the term vacuum pump refers to a device that discharges air from a certain space using high-speed compressed air in a vacuum transfer system. Among the various types of vacuum pump, a so-called "inline vacuum pump" refers to a vacuum pump that is configured such that a compressed-air supply line and an exhaust line are arranged in line with each other. This inline vacuum pump is very advantageous in terms of the design of the transfer system, because it does not require an additional pumping means. Examples of an inline vacuum pump are disclosed in U.S. Pat. No. 7,222,901 and Korean Patent No. 817254.

Referring to FIG. 1, the vacuum pump according to U.S. Pat. No. 7,222,901 includes a cylindrical housing 1, an ejector nozzle 2 which is mounted to an inner wall of the housing 1 in such a way as to be in close contact therewith, and a vacuum gripper 3 which is connected to a nozzle intake 6 of the housing 1. Further, an outlet 5 is formed at a predetermined position of the housing 1. Particularly, the nozzle 2 is delicately designed in the form of a double pipe that is bent and branched at an end thereof. An inner pipe 2*a* extends from an inlet 4 provided on one end of the pump to the outlet 5, while an outer pipe 2*b* extends from the intake 6 provided on the other end of the pump to the inlet 4 of the inner pipe.

In such a configuration, when the compressed air introduced at high speed is discharged via the inner pipe 2*a*, internal air of the gripper 3 moves along a gap between the inner pipe 2*a* and the outer pipe 2*b* and then is put into the inlet 4, so that the internal air is discharged along with the compressed air. During the exhaust process, a vacuum is created in the gripper 3, thus allowing an object to be gripped and transferred.

However, the conventional pump is problematic in that it is complicated and difficult to design, arrange and implement the components including the nozzle 2 that is delicately designed in structure. Moreover, since the universal nozzle or ejector is never applied to the pump, it is difficult to use the pump in practice.

Referring to FIG. 2, the vacuum pump according to Korean Patent No. 817254 includes a fixed pipe 7 that is secured to an additional structure, a cylindrical slider 8 that passes through the fixed pipe 7 and is arranged to be movable up and down, and a vacuum pump portion 9 that is mounted to an interior of the slider 8 in such a way as to not be in contact therewith. Further, an outlet 10 is formed at a predetermined position of the slider 8. Particularly, the slider 8 is closed at a gripper-side end 11. Around the gripper-side end, an intake passage 12 extending between the gripper and the interior of the slider 8 and a discharge passage 13 extending between the vacuum pump portion 9 and the outlet 10 are designed and processed. Here, an outlet-side end of the vacuum pump portion 9 is fitted into and connected to an entrance of the discharge passage 13.

In this configuration, when compressed air introduced at high speed passes through the vacuum pump 9 and is discharged, the internal air of the gripper flows along the intake passage 12 into the slider 8, and then is introduced into the vacuum pump portion 9 via through holes 14 to be discharged along with the compressed air. During the exhaust process, a vacuum is created in the gripper, thus allowing an object to be gripped and transferred.

However, the conventional pump is also problematic in that it is complicated and difficult to design and implement the components including the intake passage 12 and the discharge passage 13, in terms of structure. The pump also has a problem in terms of function; as the vacuum pump portion 9 moves up and down along with the slider 8, it is unstable in creating and maintaining a vacuum. Meanwhile, since the end of the vacuum pump portion 9 should be air-tightly coupled with the discharge passage 13, there is a limit in selecting a size of the vacuum pump portion, especially a length thereof.

DISCLOSURE

Technical Problem

Accordingly, the present invention has been made keeping in mind the above problems occurring in the related art. The present invention is intended to provide an inline vacuum pump, which is easier in terms of design and implementation as compared to the related art, and which allows a vacuum to be stably created and maintained. Further, the present invention is intended to provide an inline vacuum pump, which allows a nozzle or an ejector to be relatively freely selected and applied.

Technical Solution

In an aspect, the present invention provides an inline vacuum pump, including: a cylindrical housing having a discharge port formed in a lower portion of a sidewall thereof; a guide having a discharge passage that extends from a hole formed in an upper surface of the guide to a side surface thereof, and a longitudinal path that does not communicate with the discharge passage, an end of the discharge passage communicating with the discharge port when the guide is mounted in the housing; a vacuum ejector including an inlet formed in an upper end thereof, a outlet formed in a lower end thereof, and an intake formed in a sidewall thereof, the inlet being secured to an upper end of the housing and the outlet being fitted into the hole when the vacuum ejector is disposed in the housing; and a gripper connector coupled to a lower end of the housing, and having therein an exhaust passage that communicates the intake through the path.

Preferably, the path may be designed as a non-contact space between an outer wall of the guide and an inner wall of the housing.

Preferably, the connector may be designed such that the gripper coupled to the end thereof is movable up and down. Further, the connector may include a vacuum release hole for compressed air, which is formed through a predetermined portion of the connector in such a way as to communicate with the exhaust passage. More preferably, the release hole may be equipped with a non-return valve which is opened by a supply pressure of the compressed air.

Advantageous Effects

As described above, the inline vacuum pump according to the present invention includes the guide which is simply processed in a predetermined shape and is organically disposed in the housing, thus achieving desired objects. Here, the universal nozzle or ejector is used. Thus, the present invention is advantageous in that it is much easier and more convenient than the related art in terms of the design and implementation of the device. Further, according to the present invention, the guide is appropriately provided, thus allowing the ejector or the nozzle to be relatively freely selected and applied.

DESCRIPTION OF DRAWINGS

FIG. 5 is a sectional view taken along line 'A-A' of FIG. 3;

FIG. 6 is a sectional view taken along line 'B-B' of FIG. 3;

Figure 1:
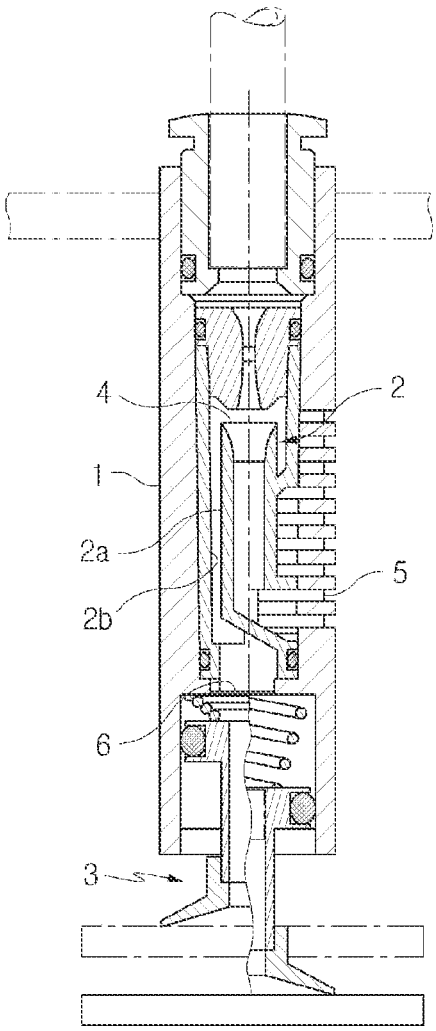
FIG. 1 is a sectional view showing a conventional inline vacuum pump.
Figure 2:
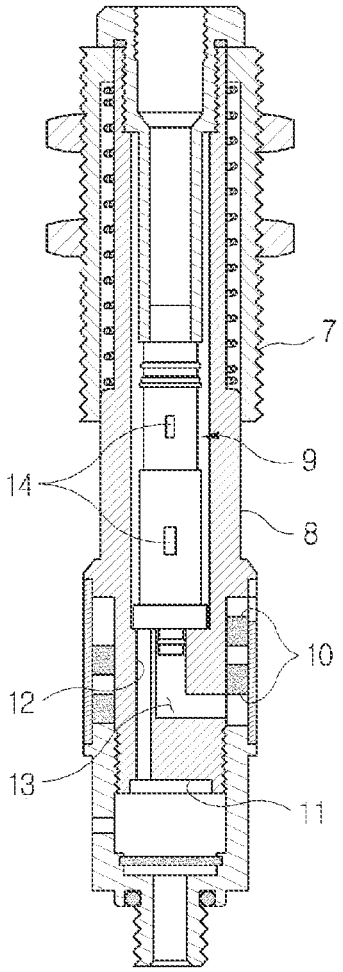
FIG. 2 is a sectional view showing another conventional inline vacuum pump.
Figure 3:
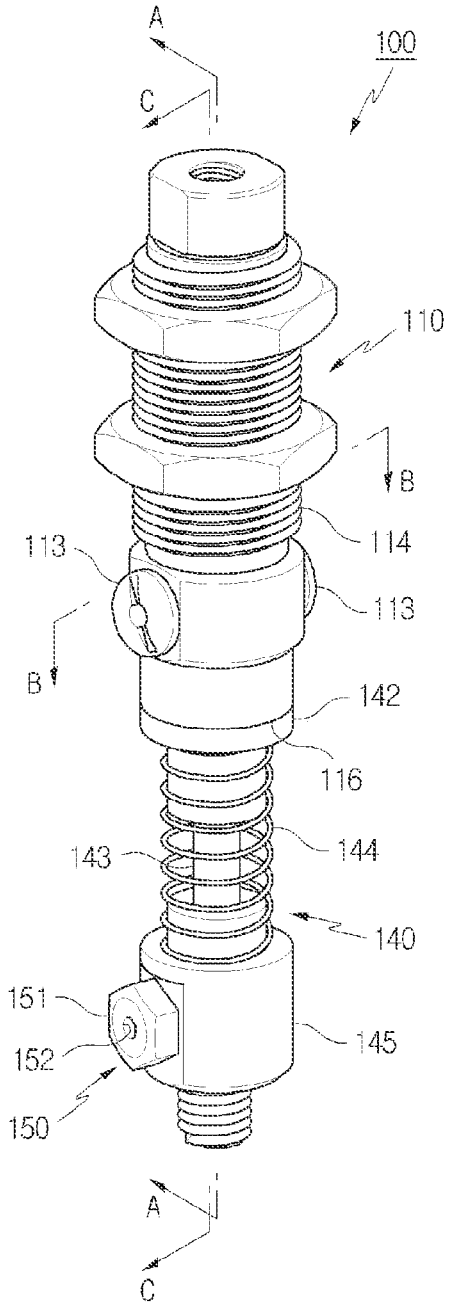
FIG. 3 is a perspective view showing an inline vacuum pump according to an embodiment of the present invention.
Figure 4:
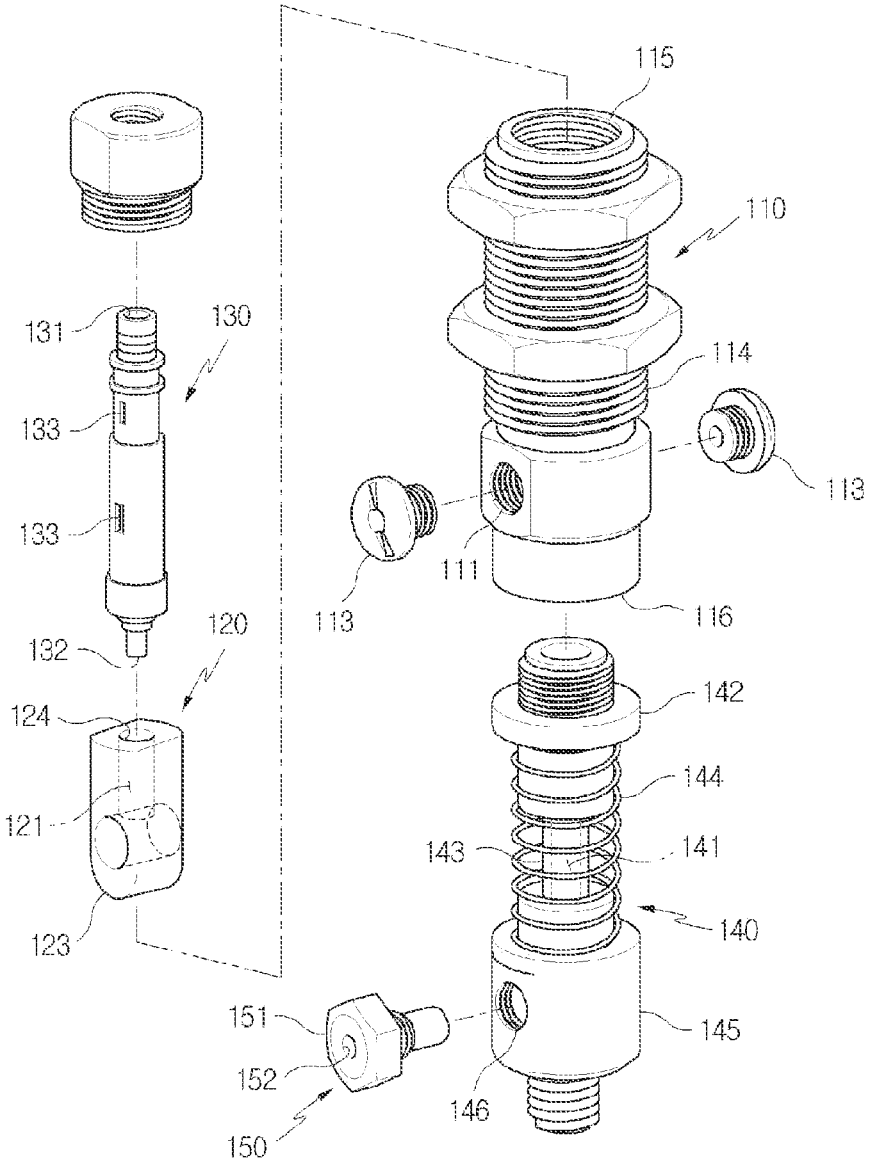
FIG. 4 is an exploded perspective view showing the inline vacuum pump of FIG. 3.

*Description of reference numerals of important parts*

| | |
|---|---|
| 100. inline vacuum pump | |
| 110. housing | 111. discharge port |
| 113. silencer | 114. threaded portion |
| 120. guide | 121. discharge passage |
| 122. path | 123. lower end surface |
| 124. hole | 130. ejector |
| 131. inlet | 132. outlet |
| 133. intake | 140. connector |
| 141. exhaust passage | 142. holder |
| 143. rod | 144. elastic member |
| 145. mass | 146. release hole |
| 150, 155. valve | 151. closing member |
| 152. supply hole | 153. check valve |
| 156. ball valve | 157. spring |

BEST MODE

The above and other features and operational effects of the present invention will be more clearly understood from the following detailed description taken in conjunction with the accompanying drawings. In the drawings of FIGS. 3 to 9, the inline vacuum pump of the present invention is denoted by reference numeral 100. Although the embodiment of FIGS. 3 to 8 is different from the embodiment of FIG. 9, like reference numerals refer to like components in terms of function throughout the drawings.

Referring to FIGS. 3 to 7, the inline vacuum pump 100 of the present invention includes a cylindrical housing 110, a guide 120 and a vacuum ejector 130 disposed in the housing 110 in series, and a gripper connector 140 coupled to a lower end of the housing 110.

The housing 110 is a cylindrical housing that has a discharge port 111 formed in a lower portion of a sidewall thereof. A silencer 113 is mounted to the discharge port 111 so as to eliminate noise resulting from the discharge of high-speed compressed air. Meanwhile, a threaded portion 114 is formed on an outer circumference of the housing 110. This is utilized to directly fasten a separate transfer robotic arm to the housing 110.

The guide 120 is a hollow block having a discharge passage 121 that extends from a hole 124 on an upper surface of the guide to a side surface, and is inserted into the housing 110. The guide 120 is installed in the housing 110 in such a way that an outer wall of the guide is in close contact with the inner wall of the housing 110. Here, an end of the discharge passage 121 directly communicates with the discharge port 111. Further, the silencer 113 extends to the discharge passage 121 located at the side surface of the guide 120, thus preventing the guide 120 from being unexpectedly rotated or moved.

Further, the guide 120 has one or more longitudinal paths 122. The path 122 functions as a narrow passage that spatially connects upper and lower portions in the housing 110, as divided by the guide 120. Naturally, the path 122 does not communicate with the discharge passage 121 and the discharge port 111.

In this embodiment, the path 122 is designed as a non-contact space between the outer wall of the guide 120 and the inner wall of the housing 110. To be more specific, the outer wall of the guide 120 includes a plane processing portion. When the outer wall of the guide 120 comes into close contact with the inner wall of the housing, a non-contact space defined between the processing portion and the circular inner wall of the housing 110 is utilized as the path 122 (see FIG. 6). Such a structure is considered to be an optimum structure in view of the processing of the guide 120 and the formation of the path 122. In another embodiment, the processing portion may be in the form of a groove on the outer wall of the guide 120.

Meanwhile, a lower end surface 123 of the guide 120 is inclined or rounded. Such a configuration allows the exhaust air to smoothly flow through the gripper connector 140 to the path 122 (see arrow of FIG. 7).

The ejector 130 is a common vacuum ejector including an inlet 131 that is provided on an upper end thereof, an outlet 132 that is provided on a lower end thereof, and an intake 133 that is provided on a sidewall thereof. The ejector 130 may include a single nozzle or a plurality of serial nozzles. The present invention may include all ejectors that are described herein without be limited to a specific ejector.

The ejector 130 is configured as follows: in the housing 110, the inlet 131 is secured to an upper end 115 of the housing 110 and the outlet 132 is fitted into the hole 124 formed in the upper surface of the guide 120, thus forming a serial structure. Here, the outlet 132 communicates with the discharge port 111 via the discharge passage 121. Thereby, the compressed air which is supplied from the inlet 131 of the ejector 130 and has passed through the outlet 132 may be discharged through the discharge passage 121 and the discharge port 112 to the outside.

Reference numeral 134 denotes a sealing member that is mounted between the ejector 130 and the guide 120 so as to prevent the unnecessary movement of the air.

The connector 140 is coupled to a lower end 116 of the housing 110, and an exhaust passage 141 is defined in the connector to communicate with the intake 133 of the ejector 130 via the path 122. Thus, the air present in the gripper may be drawn into the intake 133 and then enter the ejector 130.

According to this embodiment, the connector 140 is designed such that the gripper coupled to the end thereof is movable up and down. To be more specific, the connector 140 includes a hollow holder 142 that is integrally formed on or secured to the lower end 116 of the housing 110, a pipe-shaped rod 143 that is inserted at an upper end thereof into the holder 142 to be movable up and down, and an elastic member 144 that elastically supports the movement of the rod 143. Further, the elastic member 144 is a coil spring that is coaxially disposed outside the rod 143 and is supported at upper and lower ends thereof by the holder 142 and the rod 143, respectively.

Here, the exhaust passage 141 successively passes through the holder 142 and the rod 143, thus communicating with the internal exhaust space of the gripper that is mounted to the lower end of the rod 143.

As shown in the drawings, according to this embodiment, the rod 143 includes a mass 145 that is formed on or coupled to an end thereof, and the spring member 144 extends at both ends thereof between the holder 142 and the mass 145. Such a rod 143 is considered to suitable to arrange the elastic member 144 and to form a release hole 146 and a valve 150, which will be described below, using the mass 145. However, the present invention may not necessarily have the mass 145.

Meanwhile, the connector 140 includes the vacuum release hole 146 for compressed air, which is formed in a predetermined portion of the connector to communicate with the exhaust passage 141. A non-return valve 150 is provided in the release hole 146 to be opened or closed depending on whether there is a supply pressure of the compressed air. The release hole 146 is formed in an end of the movable rod 143, particularly, the mass 145.

Figure 8:
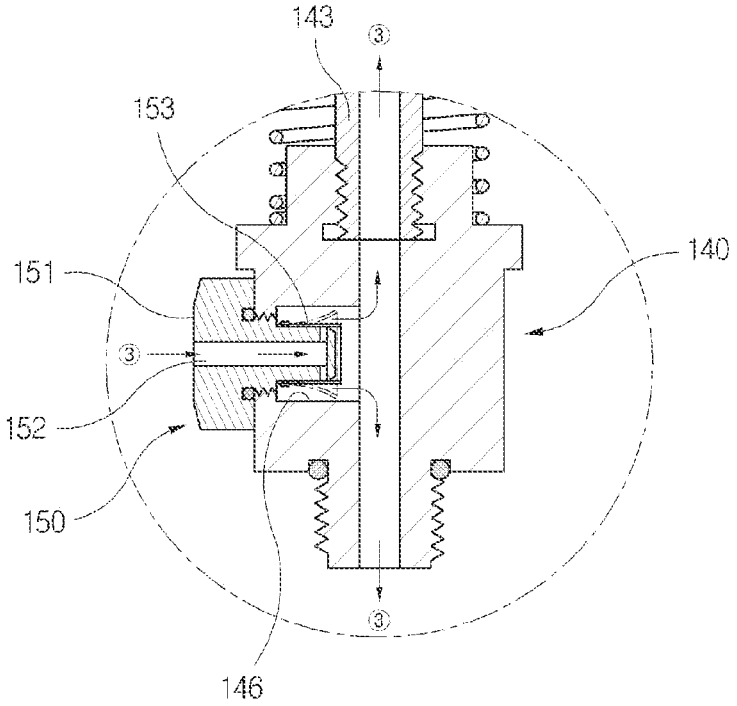
FIG. 8 is an enlarged view showing portion 'D' encircled in FIG. 5.

Referring to FIG. 8, the valve 150 includes a closing member 151 having a central supply hole 152, and a check valve 153 provided on an exit side of the supply hole 152. Further, when the closing member 151 is fitted into the release hole 146, the exit side of the supply hole 152 communicates with the exhaust passage 141 via the release hole 146. The check valve 153 is a plate made of an elastic material, and opens or closes the supply hole 151 depending on whether there is the supply pressure of the compressed air.

The inline vacuum pump 100 of the present invention configured as described above performs the following vacuum creating or releasing operation as necessary. In order to perform the operation, a vacuum gripper, such as a cup, a pad, or other forms, is coupled to an end of the connector 140, and the internal exhaust space of the gripper is connected with the exhaust passage 141 of the connector 140. Further, the gripper is in contact with a surface of an object to be worked.

For example, a plurality of inline vacuum pumps 100 is provided to transfer one object. Since the gripper coupled to the end of each vacuum pump 100 adjusts the vertical movement and level by the spring member 144 of the connector 140, each gripper can perfectly come into contact with the surface of the object to be worked even if the surface of the object is stepped or curved. In this state, an object transfer operation is carried out as follows.

Referring to arrow of FIGS. 5 and 6, the high-speed compressed air supplied to the inlet 131 of the ejector 130 passes sequentially through the outlet 132, the discharge passage 121 and the discharge port 111, and is discharged to the outside. At this time, while a pressure drop occurs in the ejector 130, particularly, the intake 133, the air present in the gripper is drawn to a position where the pressure drops, thus performing the exhaust operation.

Figure 7:
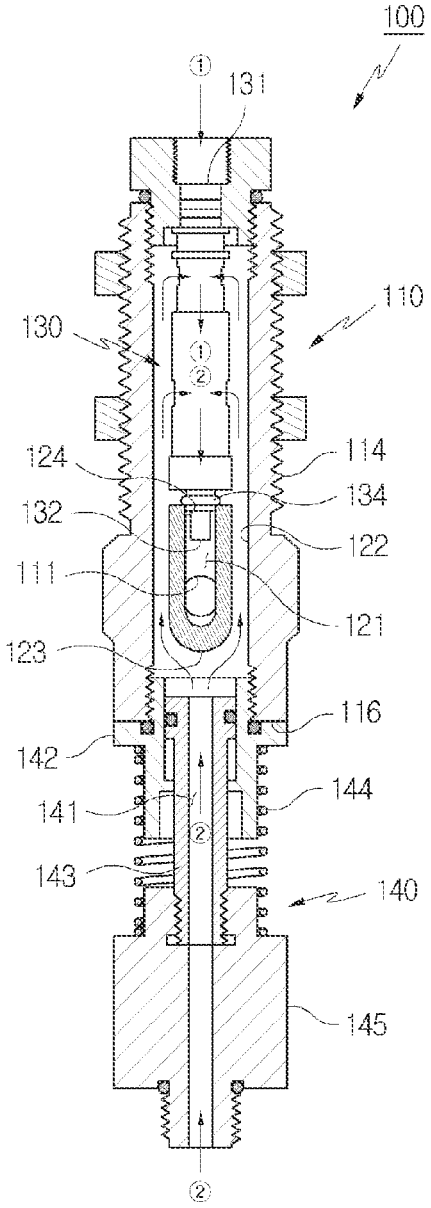
FIG. 7 is a sectional view taken along line 'C-C' of FIG. 3.

Referring to arrow of FIG. 7, the exhaust air in the gripper passes sequentially through the exhaust passage 141, the path 122 and the intake 133 and is drawn into the ejector 130. Further, the drawn air is discharged to the outside along with the compressed air (arrow of FIG. 5) passing through the ejector 130. Through such an operation, a vacuum and a negative pressure are created in the gripper. By the negative pressure generated in this way, it is possible to grip and transfer the object. For reference, as long as the compressed air is not supplied to the supply hole 152, the valve 150 is closed.

In an automatic operation, once the transfer of the object is finished, it is necessary to rapidly separate the gripper from the object.

Referring to arrow of FIG. 8, if the compressed air is supplied to the supply hole 152 of the valve 150, the check valve 153 is expanded and the valve 150 is opened. In this state, the compressed air passes sequentially through the supply hole 152, the release hole 146 and the exhaust passage 141, and flows into the gripper and the ejector 130. Then, the vacuum in the gripper is immediately released, thus separating the gripper and the object from each other.

Of course, if the supply of the compressed air to the supply hole 151 is stopped, the check valve 153 is restored to its original state and the valve 150 is closed. Thereby, the vacuum creating operation and the transfer operation are performed again. Consequently, the transfer operation is rapidly and repeatedly carried out.

Figure 9:
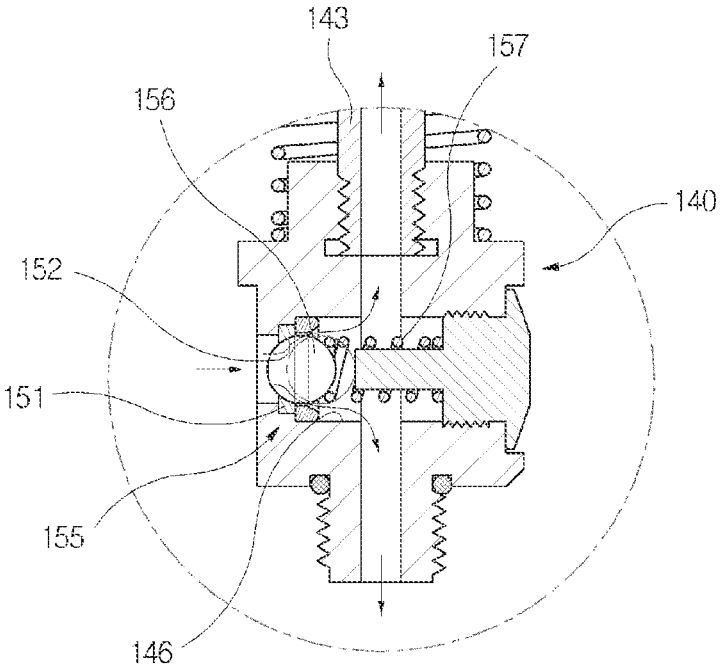
FIG. 9 is another view illustrating a valve applied to FIGS. 3 to 8.

Referring to FIG. 9, in another embodiment of the present invention, the valve 155 includes a closing member 151 having a central supply hole 152 formed therein, a ball valve 156 provided on an exit side of the supply hole 152, and a spring 157 that elastically supports the ball valve 156 in a direction opposite to the direction of the air pressure acting on the surface of the ball valve 156. Further, when the closing member 151 is fitted into the release hole 146, the exit side of the supply hole 152 communicates with the exhaust passage 141 through the release hole 146.

In this configuration, if the compressed air is supplied to the supply hole 152 of the valve 155, the ball valve 156 is pushed and the valve 155 is opened. Of course, if the supply of the compressed air is stopped, the ball valve 153 returns to its original position by the spring 157, and the valve 155 is closed. In a broad sense, the valve 155 also opens or closes the supply hole 152 depending on whether there is a supply pressure of the compressed air. In this regard, the valve is not different from the valve 150 of FIGS. 3 to 8.

The invention claimed is:

1. An inline vacuum pump, comprising:

a cylindrical housing (110) having a discharge port (111) formed in a lower portion of a sidewall thereof;

a guide (120) having a discharge passage (121) that extends from a hole (124) formed in an upper surface of the guide to a side surface thereof, and a longitudinal path (122) that does not communicate with the discharge passage, an end of the discharge passage communicating with the discharge port when the guide is mounted in the housing;

a vacuum ejector (130) including an inlet (131) formed in an upper end thereof, a outlet (132) formed in a lower end thereof, and an intake (133) formed in a sidewall thereof, the inlet being secured to an upper end of the housing and the outlet being fitted into the hole (124) when the vacuum ejector is disposed in the housing; and a gripper connector (140) coupled to a lower end of the housing, and having therein an exhaust passage (141) that communicates the intake (133) through the path (122).

2. The inline vacuum pump according to claim 1, wherein a silencer (113) is mounted to the discharge port (111), the silencer (113) extending to the discharge passage (121) on the side surface of the guide (120) so as to prevent the guide (120) from being unexpectedly rotated.

3. The inline vacuum pump according to claim 1, wherein a lower end surface (123) of the guide (120) is inclined or rounded to allow exhaust air to smoothly flow through the exhaust passage (141) of the gripper connector (140) to the path (122).

4. The inline vacuum pump according to claim 1, wherein the path (122) is designed as a non-contact space between an outer wall of the guide (120) and an inner wall of the housing (110).

5. The inline vacuum pump according to claim 1, wherein the guide (120) comprises a plane or groove processing portion formed on the outer wall thereof, the path (122) is a non-contact space defined between the processing portion of the guide (120) and the circular inner wall of the housing (110) when the outer wall of the guide (120) comes into contact with the inner wall of the housing (110).

6. The inline vacuum pump according to claim 1, wherein the connector (140) comprises:

a hollow holder (142) integrally formed on or secured to the lower end of the housing (110);

a pipe-shaped slide rod (143) inserted at an upper end thereof into the holder (142); and a spring member (144) coaxially disposed outside the rod (143) to elastically support a vertical movement of the rod (143), wherein the exhaust passage (141) successively passes through the holder (142) and the rod (143), thus communicating with an internal exhaust space of the gripper that is mounted to a lower end of the rod (143).

7. The inline vacuum pump according to claim 6, wherein the connector (140) comprises a vacuum release hole (146) for compressed air which is formed through a predetermined portion of the rod (143) in such a way as to communicate with the exhaust passage (141).

8. The inline vacuum pump according to claim 7, wherein the rod (143) comprises a mass (145) formed on or coupled to an end thereof, and the release hole (146) is formed in the mass (145).

9. The inline vacuum pump according to claim 1, wherein a threaded portion (114) is formed on an outer circumference of the housing (110) to allow a robotic arm to be directly coupled to the housing (110).

10. The inline vacuum pump according to claim 1, wherein the connector (140) comprises a vacuum release hole (146) for compressed air, which is formed through a predetermined portion of the connector in such a way as to communicate with the exhaust passage (141).

11. The inline vacuum pump according to claim 10, wherein the release hole (146) is equipped with a non-return valve (150, 155) which is opened by a supply pressure of the compressed air.

12. The inline vacuum pump according to claim 11, wherein the valve (155) comprises:

a closing member (151) having a supply hole (152) formed in a center thereof, the closing member being fitted into the release hole (146) to allow the supply hole (152) to communicate with the exhaust passage via the release hole (146);

a ball valve (156) provided on an output side of the supply hole (152) and opened by the supply pressure of the compressed air; and a spring (157) elastically supporting the ball valve (156) in a direction opposite to that of the air pressure.

13. The inline vacuum pump according to claim 11, wherein the valve (150) comprises:

a closing member (151) having a supply hole (152) formed in a center thereof, the closing member being fitted into the release hole (146) to allow the supply hole (152) to communicate with the exhaust passage via the release hole (146); and a check valve (153) provided on an output side of the supply hole (152) and opened by the supply pressure of the compressed air.

14. The inline vacuum pump according to claim 13, wherein the check valve (153) is a plate that is made of an elastic material.

* * * * *